US005441236A

United States Patent [19]

Kiernan

[11] Patent Number: 5,441,236

[45] Date of Patent: Aug. 15, 1995

[54] HAMMERS WITH CLAWS AND ADJUSTABLE PIVOT POINTS

[76] Inventor: Robert J. Kiernan, 606 W. Picaacho Dr., La Habra, Calif. 90631

[21] Appl. No.: 208,219

[22] Filed: Mar. 10, 1994

[51] Int. Cl.[6] ..... B25C 11/00

[52] U.S. Cl. ..... 254/26 E

[58] Field of Search ..... 254/26 E, 26 R, 25, 254/27; 81/169, 170, 175, 20

[56] References Cited

U.S. PATENT DOCUMENTS 4,422,620 12/1983 Nitzberg ..... 254/26 E 4,998,996 3/1991 Belanger ..... 254/26 E

*Primary Examiner*—Robert C. Watson

[57] ABSTRACT

A hammer with claws and an adjustable pivot point comprising, of an elongated handle with a first gripping end for being held by a user, a second operational end for driving and removing nails, an exterior surface for being held by a user, a cylindrical interior surface extending axially through the length of the handle, and inserts with internal screw threads positioned on the interior surface adjacent the first and second ends. A head having a nail driving side with a flat surface and a nail removing side with a claw having a V-shaped slot positionable under the head of a nail to be removed and a cylindrical bore therebetween, the bore being positioned onto the exterior surface of the handle at the first end. An adjustable rod, the adjustable rod being formed as a rigid cylinder or a plurality of telescoping rigid cylinders with exterior screw threads rotatably received within the screw threads of the handle whereby rotation of the rod within the handle will axially shift the rod, the rod being of a length of between about 123 and 143 percent greater than the length of the handle, a narrow knob positioned at the end of the rod adjacent to the first end and a fulcrum positioned on the end of the rod adjacent to the second end.

2 Claims, 4 Drawing Sheets

HAMMERS WITH CLAWS AND ADJUSTABLE PIVOT POINTS

BACKGROUND OF THE INVENTION

1. Field of the Invention

The present invention relates to hammers with claws and adjustable pivot points and more particularly pertains to removing nails with hammer claws having adjustable pivot points for nails of varying sizes.

2. Description of the Prior Art

The use of hammers with claws is known in the prior art. More specifically, hammers with claws heretofore devised and utilized for the purpose of removing nails with claws of hammers are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,002,257 to Evans a brick hammer with nail puller.

U.S. Pat. Nos. 4,561,635 to Lamansky discloses a nail removing hammer.

U.S. Pat. No. 3,963,215 to Connor discloses a nail extractor tool.

U.S. Pat. No. 3,885,772 to Balkus, Jr. discloses a nail puller for claw hammers.

U.S. Pat. No. Des. 262,513 discloses a design patent of a slide hammer nail puller.

In this respect, the hammers with claws and adjustable pivot points according to the present invention substantially departs from the conventional concepts and designs of the prior art, and in doing so provides an apparatus primarily developed for the purpose of removing nails with hammer claws having adjustable pivot points for nails of varying sizes.

Therefore, it can be appreciated that there exists a continuing need for new and improved hammers with claws and adjustable pivot points which can be used for removing nails with hammer claws having adjustable pivot points for nails of varying sizes. In this regard, the present invention substantially fulfills this need.

SUMMARY OF THE INVENTION

In view of the foregoing disadvantages inherent in the known types of hammers with claws now present in the prior art, the present invention provides an improved hammers with claws and adjustable pivot points. As such, the general purpose of the present invention, which will be described subsequently in greater detail, is to provide a new and improved hammers with claws and adjustable pivot points and method which has all the advantages of the prior art and none of the disadvantages.

To attain this, the present invention essentially comprises of a new and improved hammer with claws and an adjustable pivot point comprising, in combination, an elongated handle with a first gripping end for being held by a user, a second operational end for driving and removing nails, an exterior surface for being held by a user, a cylindrical interior surface extending axially through the length of the handle, and inserts with internal screw threads positioned on the interior surface adjacent the first and second ends. A head having a nail driving side with a flat surface and a nail removing side with a claw having a V-shaped slot positionable under the head of a nail to be removed and a cylindrical bore therebetween, the bore being press fit onto the exterior surface of the handle at the first end. An adjustable rod, the adjustable rod being formed as a rigid cylinder with exterior screw threads rotatably received within the screw threads of the handle whereby rotation of the rod within the handle will axially shift the rod, the rod being of a length of about 120 percent greater than the length of the handle, a narrow knob positioned at the end of the rod adjacent to the first end and a domed fulcrum positioned on the end of the rod adjacent to the second end, the fulcrum having a radius of curvature, in all directions whereby the knob may be rotated by a user to vary the location of the fulcrum with respect to the handle, head and claw so that the claw may remove nails of varying sizes by pivoting about the fulcrum at a preselected distance from the claw and nail to be removed.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved hammers with claws and adjustable pivot points which have all the advantages of the prior art hammers with claws and none of the disadvantages.

It is another object of the present invention to provide new and improved hammers with claws and adjustable pivot points which may be easily and efficiently manufactured and marketed.

It is further object of the present invention to provide new and improved hammers with claws and adjustable pivot points which are of durable and reliable constructions.

An even further object of the present invention is to provide new and improved hammers with claws and adjustable pivot points which are susceptible of a low cost of manufacture with regard to both materials and labor, and which accordingly are then susceptible of low prices of sale to the consuming public, thereby making such hammers with claws and adjustable pivot points economically available to the buying public.

Still yet another object of the present invention is to provide new and improved hammers with claws and adjustable pivot points which provide in the apparatuses and methods of the prior art some of the advantages thereof, while simultaneously overcoming some of the disadvantages normally associated therewith.

Still another object of the present invention is to removing nails with hammer claws having adjustable pivot points for nails of varying sizes.

Lastly, it is an object of the present invention to provide new and improved hammer with claws and an adjustable pivot point comprising, an elongated handle with a first gripping end for being held by a user, a second operational end for driving and removing nails, an exterior surface for being held by a user, a cylindrical interior surface extending axially through the length of the handle, and inserts with internal screw threads positioned on the interior surface adjacent the first and second ends. A head having a nail driving side with a flat surface and a nail removing side with a claw having a V-shaped slot positionable under the head of a nail to be removed and a cylindrical bore therebetween, the bore being positioned onto the exterior surface of the handle at the first end. An adjustable rod, the adjustable rod being formed as a rigid cylinder with exterior screw threads rotatably received within the screw threads of the handle whereby rotation of the rod within the handle will axially shift the rod, the rod being of a length of between about 123 and 143 percent greater than the length of the handle, a narrow knob positioned at the end of the rod adjacent to the first end and a fulcrum positioned on the end of the rod adjacent to the second end.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
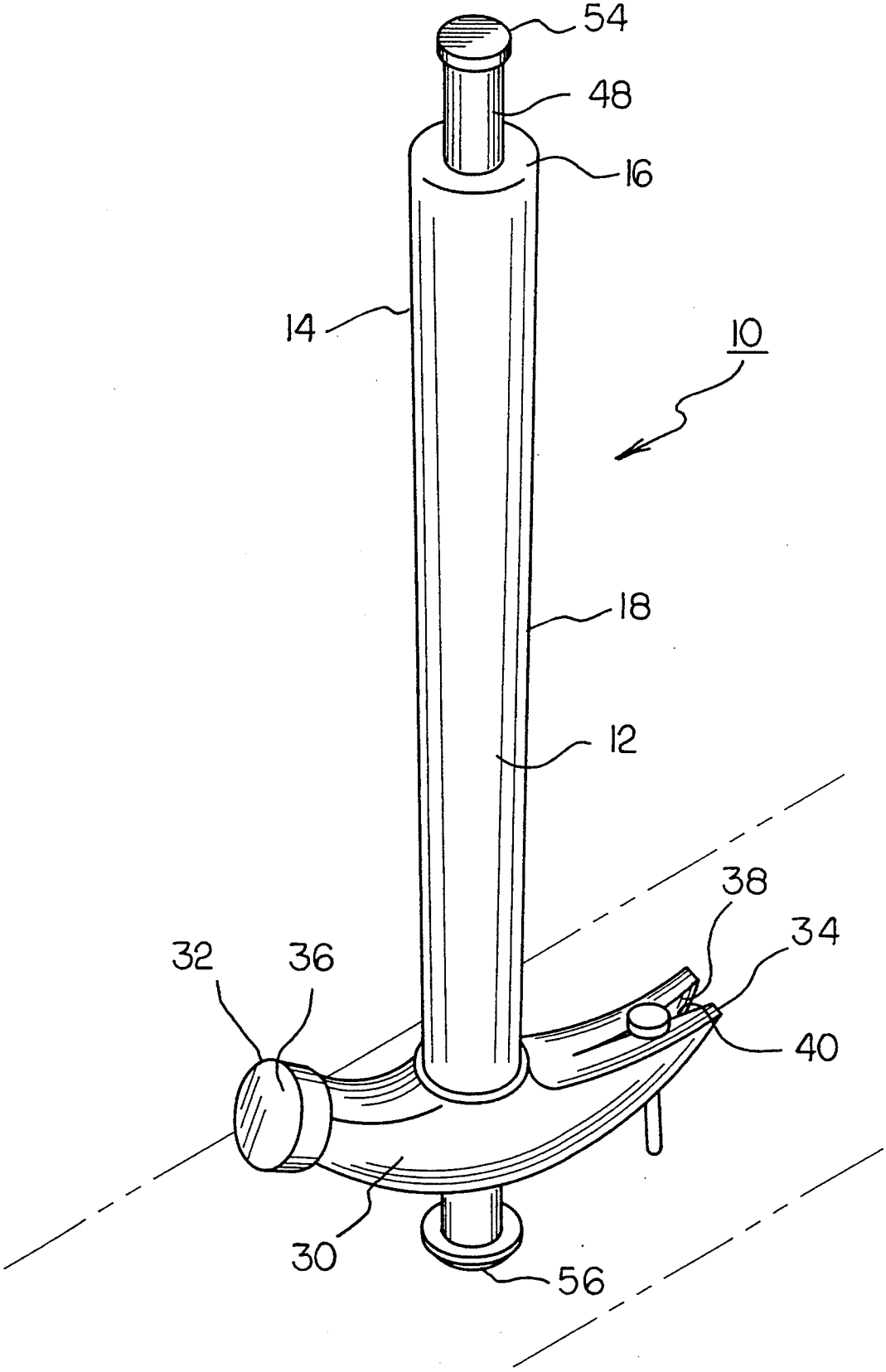
FIG. 1 is a perspective illustration of the preferred embodiment of the new and improved HAMMER WITH CLAWS AND ADJUSTABLE PIVOT POINTS constructed in accordance with the principles of the present invention.
Figure 2:
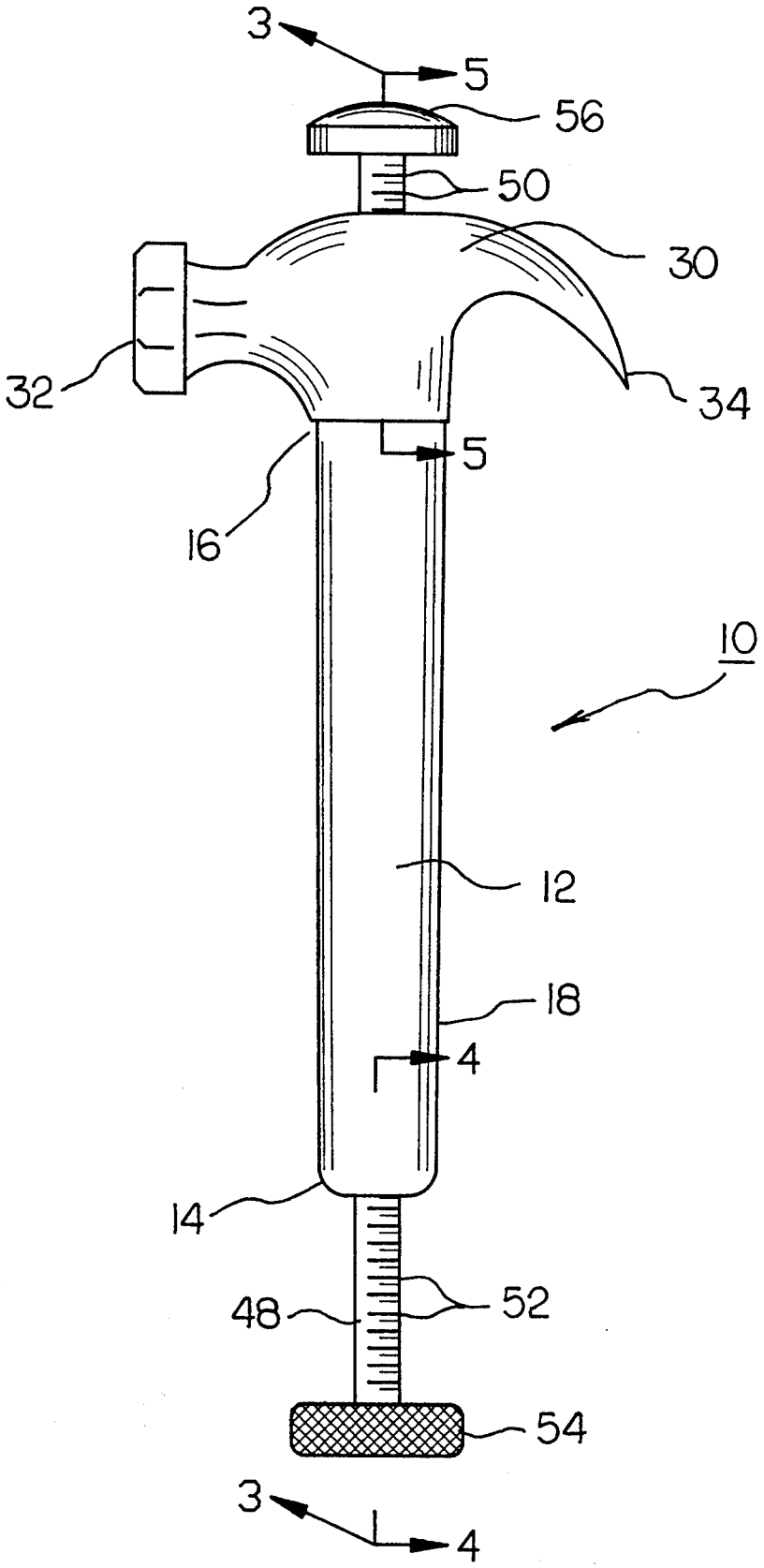
FIG. 2 is a front elevational view of the hammer shown in FIG. 1.
Figure 3:
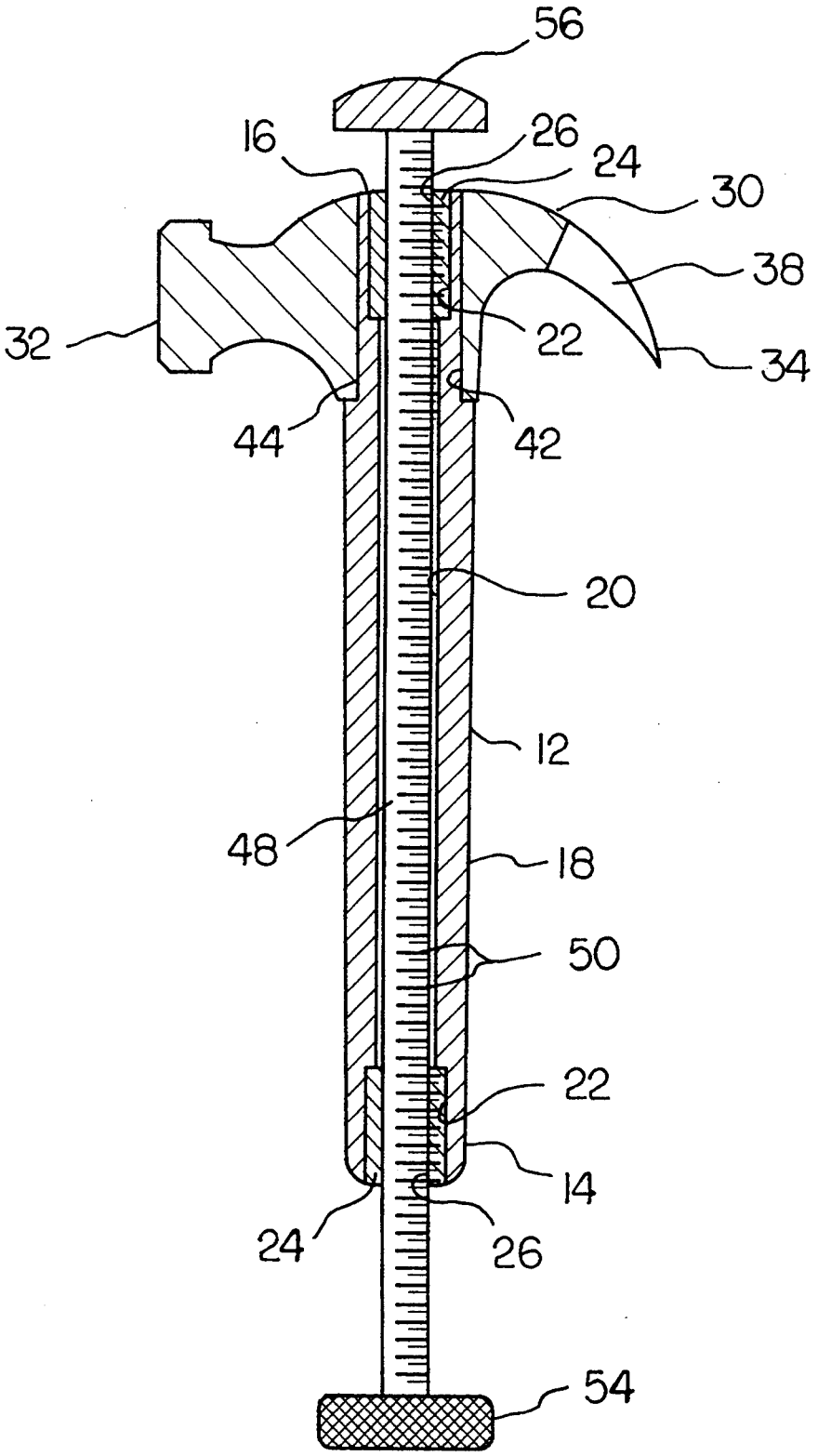
FIG. 3 is a cross-sectional view taken along line 3—3 of FIG. 2.
Figure 5:
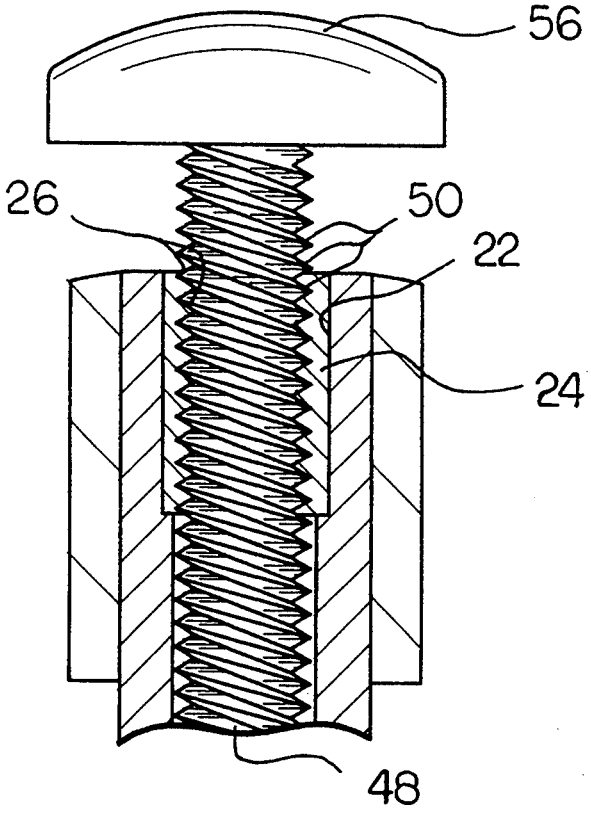
FIG. 5 is a cross-sectional view of the upper portion of the hammer taken along line 5—5 of FIG. 2.
Figure 4:
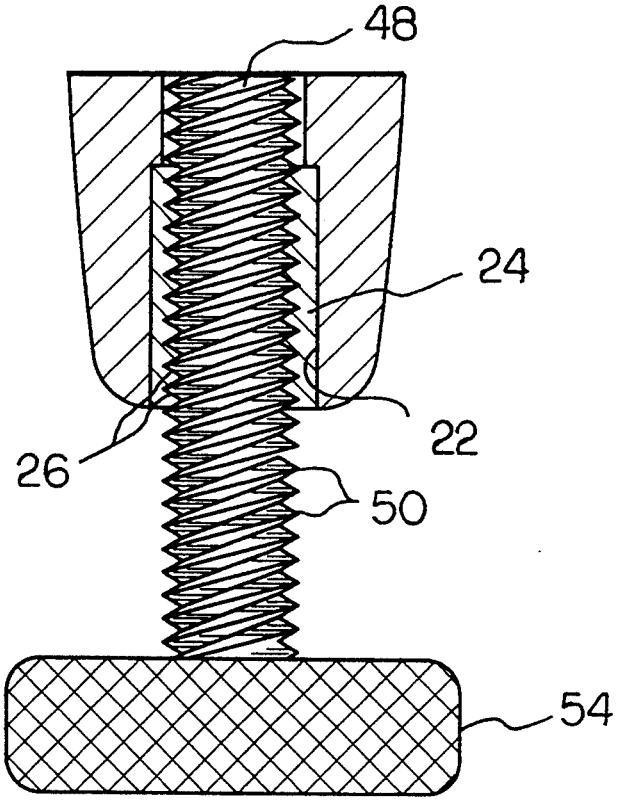
FIG. 4 is a cross-sectional view of the lower portion of the hammer taken along line 4—4 of FIG. 2.

With reference now to the drawings, and in particular to FIG. 1 thereof, the preferred embodiment of the new and improved hammers with claws and adjustable pivot points embodying the principles and concepts of the present invention and generally designated by the reference numeral 10 will be described.

Specifically, the present invention, the new and improved HAMMER WITH CLAWS AND ADJUSTABLE PIVOT POINTS, is comprised of a plurality of components. In their broadest context, such components include the handle, the head, and an adjusting rod. Such components are specifically configured and correlated one with respect to the other so as to attain the desired objectives.

More specifically, the hammer 10 has an elongated handle 12. The handle 12 has a first gripping end 14 for being held by a user. It also has a second operational end 16 for driving nails and for removing nails. The exterior surface 18 of the handle is configured for being held by a user. An interior surface 20 is hollow and of a cylindrical configuration. It extends axially through the entire length of the handle from the first end to the second end. In addition, the first end and the second end of the handle are provided with recesses 22. Located within such recesses are inserts 24. The inserts are press fit into the ends of the hammer and have, on their interior surfaces, screw threads 26 positioned adjacent to the first and second ends but of a diameter slightly less than the diameter of the portion of the bore through the handle between the inserts.

The next component of the hammer is the head 30. The head has two sides, a nail driving side 32 and a nail removing side 34. The nail driving side is provided with a flat surface 36. The nail removing side is provided with a claw 38. The claw is formed with a generally V-shaped slot 40. The edges of the slot are positionable under the head of a nail to be removed. In addition, a cylindrical bore 42 is formed in the head between the two sides. The bore of the head is press fit onto a recess 44 on the exterior surface of the handle adjacent to the first end.

The final component of the hammer 10 of the present invention is an adjusting rod 48. The adjusting rod is formed as a rigid cylinder. It has exterior screw threads 50 along its length. The threads are rotatably received within the screw threads of the handle. In this manner, rotation of the adjusting rod within the handle will axially shift the adjusting rod.

The adjusting rod is of a length about 133 percent greater than the length of the handle. The length may be from between about 123 percent to about 133 percent of the length of the handle. At the end of the rod adjacent to the handle end there is provided a knurled knob 54. The knob is adapted to be grasped by the user to assist in rotating the adjusting rod. This is at the first end of the handle. At the second end of the handle there is provided a domed fulcrum 56. The domed fulcrum is positioned on the end of the rod adjacent to the first end for movement with the rod. The fulcrum had a radius of curvature, in all directions. In this manner the knob may be rotated by the user. Such rotation functions to vary the location of the fulcrum with respect to the handle, head and claw. In this manner, the claw may remove nails of varying lengths by pivoting about the fulcrum when positioned at a predetermined distance from the claw and nail to be removed.

Hammers with claws and adjustable pivot points solves one of the most common problems which is encountered when using the claw to remove nails. Everyone who has ever used a claw hammer has experienced this difficulty when they attempt to remove long nails. The perpendicular distance between the arc of the top of the hammerhead and the bottom of the slot in the claw is fixed. Since the arc serves as the fulcrum, when the claw is used like a lever to pro the nail out of the wood, the length of the nail cannot exceed this distance. When it is longer, the arc can no longer be used as the fulcrum and the nail cannot he pried out any further. The most common method used to circumvent this problem is to place a spacer block of suitable thickness under the arc in the slot of the claw, allowing the hammer to pull out a longer nail. The spacer is adequate, but the work must be interrupted to find it. This is not always easy, and a great deal of time may be wasted in searching for a block of specific dimensions, and in many instances, using additional spacer blocks to adjust for the length of the nail.

A threaded bolt through the axis of the handle of the hammer with claws and adjustable pivot points is used as the pivot point for the claw. When the nail is longer than can be handled by the claw, the bolt is simply turned to extend its head sufficiently above the arc to obtain the leverage needed to remove the long nail completely. No time is wasted looking for a spacer block because the bolt is adjusted to any length that is needed in only seconds on the job, on the spot, on the ladder or scaffolding, and virtually anywhere. The bolt can be extended completely through the handle with a knurled knob at the bottom for easier turning.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hammer with claws and an adjustable pivot point comprising, in combination:

an elongated handle with a first gripping end for being held by a user, a second operational end for driving and removing nails, an exterior surface for being held by a user, a cylindrical interior surface extending axially through the length of the handle, and inserts with internal screw threads positioned on the interior surface adjacent the first and second ends;

a head having a nail driving side with a flat surface and a nail removing side with a claw having a V-shaped slot positionable under the head of a nail to be removed and a cylindrical bore therebetween, the bore being press fit onto the exterior surface of the handle at the first end; and an adjustable rod, the adjustable rod being formed as a rigid cylinder with exterior screw threads rotatably received within the screw threads of the handle whereby rotation of the rod within the handle will axially shift the rod, the rod being of a length of about 120 percent greater than the length of the handle, a narrow knob positioned at the end of the rod adjacent to the first end and a domed fulcrum positioned on the end of the rod adjacent to the second end, the fulcrum having a radius of curvature, in all directions whereby the knob may be rotated by a user to vary the location of the fulcrum with respect to the handle, head and claw so that the claw may remove nails of varying sizes by pivoting about the fulcrum at a preselected distance from the claw and nail to be removed.

2. A hammer with claws and an adjustable pivot point comprising:

an elongated handle with a first gripping end for being held by a user, a second operational end for driving and removing nails, an exterior surface for being held by a user, a cylindrical interior surface extending axially through the length of the handle, and inserts with internal screw threads positioned on the interior surface adjacent the first and second ends;

a head having a nail driving side with a flat surface and a nail removing side with a claw having a V-shaped slot positionable under the head of a nail to be removed and a cylindrical bore therebetween, the bore being positioned onto the exterior surface of the handle at the first end; and an adjustable rod, the adjustable rod being formed as rigid cylinder means with exterior screw threads rotatably received within the screw threads of the handle whereby rotation of the rod within the handle will axially shift the rod, the rod being of a length of between about 123 and 143 percent greater than the length of the handle, a narrow knob positioned at the end of the rod adjacent to the first end and a fulcrum positioned on the end of the rod adjacent to the second end.

* * * * *